US009474132B1

(12) United States Patent
Lee

(10) Patent No.: US 9,474,132 B1
(45) Date of Patent: Oct. 18, 2016

(54) LIGHT CONTROL DEVICE AND SYSTEM, AND METHOD OF LIGHT CONTROL

(71) Applicant: UNIFORM INDUSTRIAL CORP., New Taipei (TW)

(72) Inventor: Hsi-Wen Lee, New Taipei (TW)

(73) Assignee: UNIFORM INDUSTRIAL CORP., New Taipei (TW)

( * ) Notice: Subject to any disclaimer, the term of this patent is extended or adjusted under 35 U.S.C. 154(b) by 0 days.

(21) Appl. No.: 14/744,884

(22) Filed: Jun. 19, 2015

(51) Int. Cl.
*H05B 37/02* (2006.01)
*H05B 33/08* (2006.01)

(52) U.S. Cl.
CPC ..... *H05B 37/0236* (2013.01); *H05B 33/0845* (2013.01); *H05B 37/0272* (2013.01)

(58) Field of Classification Search
USPC ..... 315/291, 307, 312, 152, 154; 398/130, 398/172; 345/156, 204, 169, 170, 173
See application file for complete search history.

(56) References Cited

U.S. PATENT DOCUMENTS

2014/0055041 A1* 2/2014 Ramer ..... H05B 37/0209 315/153
2014/0085093 A1* 3/2014 Mittleman ..... H04L 12/282 340/628
2014/0186049 A1* 7/2014 Oshima ..... H04B 10/1143 398/118
2014/0267002 A1* 9/2014 Luna ..... H04M 1/7253 345/156
2015/0172878 A1* 6/2015 Luna ..... H04W 4/12 455/412.2

* cited by examiner

*Primary Examiner* — Minh D A
(74) *Attorney, Agent, or Firm* — Muncy, Geissler, Olds & Lowe PC

(57) ABSTRACT

A light control device and system and a method of light control are disclosed. The light control system includes an editing device and a light control device. The editing device includes an editing module, a screen, and a wireless communication module. The editing module includes an editing interface including an input block. The screen displays the editing interface. When the input block is activated, the editing module records the time of the activation of the input block in a light control pattern. The wireless communication module receives the light control pattern for transmission. The light control device includes a network module and a control module. The network module receives the light control pattern via wireless communication protocol. The control module generates a set of light control commands in accordance with the light control pattern and outputs the set of light control commands for controlling one or more lighting device.

19 Claims, 10 Drawing Sheets

LIGHT CONTROL DEVICE AND SYSTEM, AND METHOD OF LIGHT CONTROL

BACKGROUND

1. Technical Field

The instant disclosure relates to a control device and system, and more particularly, to a light control device and system, and a method of light control.

2. Related Art

During holidays such as Christmas or New Year, many people like to decorate their houses or yards with light strings. Along with night coming and the light strings turning on, the decorated houses or yards have magnificent atmosphere and make people whoever passes by or lives in feel pleasant. A kind of music boxes commercially available connected to the light strings can be used for light control with music playing. The product can increase the effects in the manner of combining light and music. Such music box has a quantity of music and light control patterns respectively corresponding to the music. The music and light control patterns are pre-installed in a memory or a secure digital card (SD card) in the music box. Each of the light control patterns is used to control light strings to turn on or off instantaneously in accordance with the rhythms of respective one of the music. To a certain extent, the music is visualized by the light control. Consequently, effects created by combining light control of light strings with music are more attractive than that created by light strings decoration only. Although the music box is of benefit to increase atmosphere, the music and the light control patterns are usually default and are hard to be edited by users.

SUMMARY

Products of prior arts regarding light control are hard to be customized to meet vary scenarios and needs. In addition, pre-installed music and corresponding light control patterns stored in memories of music boxes of prior arts are hard to be changed. Even music and corresponding light control patterns are stored in SD cards inserted in slots of the music boxes of prior arts, users, for example in need of changing music, have to manually take the old SD cards out and insert new ones. To address the above issue, the instant disclosure provides a light control device and system, and a method of light control.

In an embodiment, the light control device comprises a network module and a control module. The network module receives at least a light control pattern from an editing device or a cloud server via wireless communication protocol. The control module generates at least a set of light control commands in accordance with the light control pattern and outputs the set of light control commands for controlling at least a lighting device.

According to an embodiment of the instant disclosure, the network module further receives at least a media file. The light control pattern is in accordance with sounds of the media file. The control module outputs the set of light control commands for controlling the lighting device when the media file is played.

According to an embodiment of the instant disclosure, the light control device further comprises a sound output module. The sound output module is capable of being signally connected to a speaker and outputting signals of sounds of the media file.

According to an embodiment of the instant disclosure, the editing device is a smart phone, a tablet computer, or a laptop computer.

The instant disclosure further provides embodiments of the light control system. In an embodiment, the light control system comprises an editing device and at least a light control device. The editing device comprises an editing module, a screen, and a wireless communication module. The editing module comprises an editing interface. The editing interface comprises an input block. The screen displays the editing interface. When the input block is activated, the editing module records the time of the activation of the input block in a light control pattern. The wireless communication module receives the light control pattern for transmission. The light control device comprises a network module and a control module. The network module receives the light control pattern via wireless communication protocol. The control module generates at least a set of light control commands in accordance with the light control pattern and outputs the set of light control commands for controlling at least a lighting device.

According to an embodiment of the instant disclosure, the editing interface further comprises a channel block. When a channel of the channel block is activated, the editing module makes a sign on the activated channel and relates the light control pattern to the activated channel.

According to an embodiment of the instant disclosure, the editing device further comprises a memory. The editing interface further comprises a save block. When the save block is activated, the editing module saves the recorded light control pattern in the memory.

According to an embodiment of the instant disclosure, the light control system further comprises a cloud server. When the save block is activated, the editing device transmits the light control pattern to the cloud server, and the network module of the light control device receives the light control pattern from the cloud server.

According to an embodiment of the instant disclosure, the editing interface further comprises an effect block. When an effect of the effect block is activate, the editing module has the activated effect correspond to the time of the activation of the input block in the light control pattern.

According to an embodiment of the instant disclosure, the effect block comprises a first effect selection and a second effect selection. The first effect selection is related to a light turning on or off effect of controlling the lighting device. The second effect selection is related to a light fading up or out effect of controlling the lighting device.

According to an embodiment of the instant disclosure, the screen is a touch screen. The input block is activated when an area of the touch screen related to the input block senses a point-touch signal or a gesture-touch signal.

According to an embodiment of the instant disclosure, the editing interface further comprises a media-playing block playing at least a media file. The editing module records the time of the activation of the input block in accordance with the playing of the media file in the light control pattern when the input block is activated. The wireless communication module further receives the media file for transmission. The network module accordingly receives the media file via wireless communication protocol. The control module outputs the set of light control commands for controlling the lighting device when the media file is played.

According to an embodiment of the instant disclosure, the editing device, the light control device, or the cloud server further comprises a pattern-generating module. The pattern-generating module is capable of automatically generating a generated light control pattern in accordance with characteristics of sounds of the media file.

The instant disclosure further provides embodiments of the method of light control. In an embodiment, the method of light control comprises steps of: wirelessly receiving a light control pattern from an editing device or a cloud server by a light control device; generating a set of light control commands in accordance with the light control pattern on the light control device; and driving at least a lighting device in accordance with the set of light control commands by the light control device.

According to an embodiment of the instant disclosure, the method of light control further comprises step of generating an editing interface on the editing device. The editing interface comprises an input block and a save block. The input block has, when activated, the time of activation of the input block recorded in the light control pattern. The save block saves, when activated, the light control pattern.

The light control device and system of the instant disclosure are of benefit to customization, edition, and transmission with regard to light control. Users can easily edit light control patterns on the editing device in an instinctive manner. Music and edited light control patterns can be conveniently transmitted to the light control device via wireless communication protocol.

The features of the instant disclosure will no doubt become understandable to those of ordinary skill in the art after reading the following detailed description of the preferred embodiment that is illustrated in the various figures and drawings.

DETAILED DESCRIPTION

Figure 1:
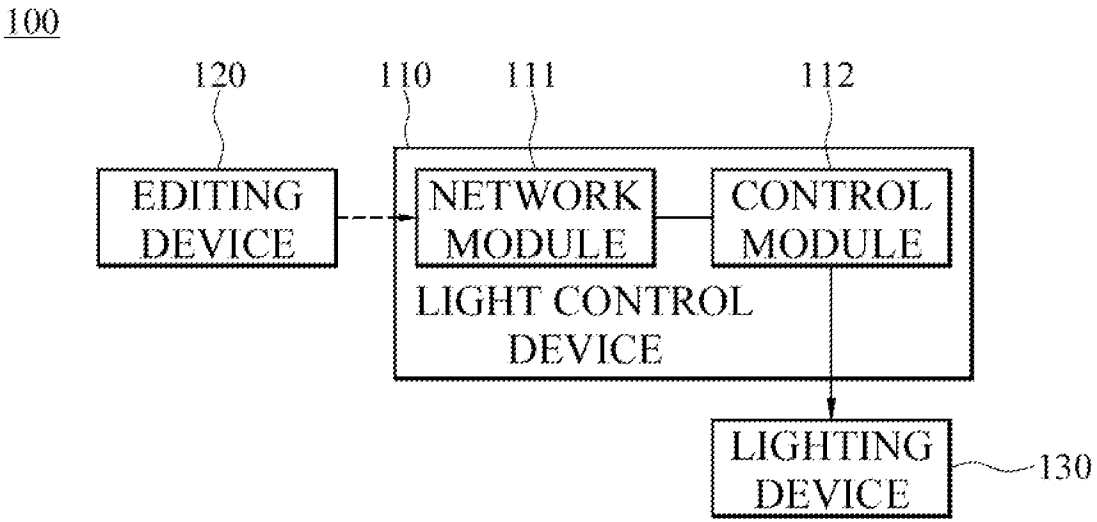
FIG. 1 illustrates a block diagram of a light control system according to a first embodiment of the instant disclosure.

Referring to FIG. 1, FIG. 1 illustrates a block diagram of a light control system 100 according to a first embodiment of the instant disclosure. In the embodiment, the light control system 100 comprises at least a light control device 110, an editing device 120, and at least a lighting device 130. The editing device 120 is signally connected to the light control device 110 via wireless communication protocol. The lighting device 130 is connected to the light control device 110 via wires. In another embodiment, the editing device may be connected to the light control device via wires, and the lighting device may be signally connected to the light control device via wireless communication protocol. In the embodiment, the light control device 110 comprises a network module 111 and a control module 112. Users can use the editing device 120 to create, record, and/or edit at least a light control pattern. During operation, the network module 111 receives the light control pattern from the editing device 120 via wireless communication protocol, and the control module 112 generates at least a set of light control commands in accordance with the light control pattern and outputs the set of light control commands for controlling the lighting device 130. In the embodiment, the light control pattern is a pattern recording time and corresponding lighting effects related to particular time. The lighting effect is a light turning on or off effect or a light fading up or out. The light control commands can be recognized by the lighting device 130 so that the controlling of the lighting device 130 can be performed according to the light control commands. The editing device 120 is, but is not limited to, a smart phone, a tablet computer, or a laptop computer. The lighting device 130 is, but is not limited to, a light string with several LEDs (light emitting diodes) disposed thereon.

For example, the length of time of the light control pattern for controlling the lighting device 130 is 5 minutes. The relative positions of 01:00, 02:16, and 04:30 in the light control pattern are respectively recorded with light turning on and off effects, and the relative position of 04:59 in the light control pattern is recorded with a light turning on effect. When the light control device 110 starts to control the lighting device 130 and the light control pattern is executed, the lighting device 130 starts from 00:00 with no light turning on. When the time comes to 01:00, the lighting device 130 is turned on and off, like a flash. When the time comes to 02:16 and 04:30, the lighting device 130 is also turned on and off respectively. When the time comes to 04:59, the lighting device 130 is turned on and keeps turned on even the light control pattern is over and the control module 112 stops transmitting the light control commands. In another embodiment, the lighting device may be turned off in any case when the control module stops transmitting the light control commands.

Figure 2:
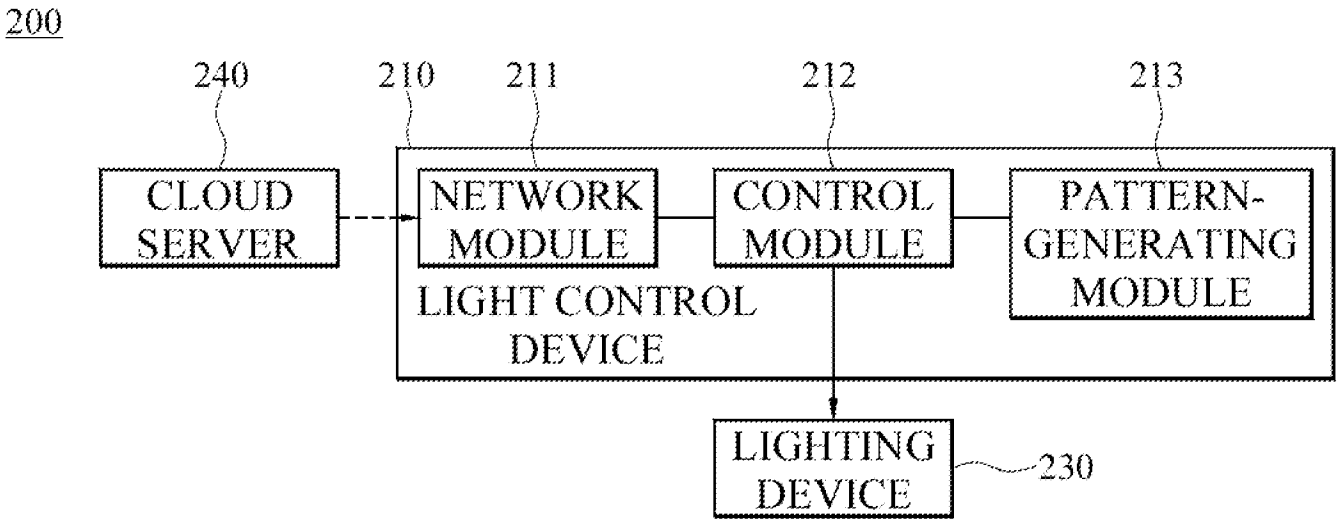
FIG. 2 illustrates a block diagram of a light control system according to a second embodiment of the instant disclosure.

Referring to FIG. 2, FIG. 2 illustrates a block diagram of a light control system 200 according to a second embodiment of the instant disclosure. The light control system 200 of FIG. 2 is similar to the light control system 100 of FIG. 1. In the embodiment, the light control system 200 comprises a light control device 210, a lighting device 230, and a cloud server 240. The cloud server 240 is signally connected to the light control device 210 via wireless communication protocol. The lighting device 230 is connected to the light control device 210 via wires. The light control device 210 comprises a network module 211, a control module 212, and a pattern-generating module 213. The cloud server 240 is stored at least a light control pattern and at least a media file. The media file is, but is not limited to, an audio file such as mp3 file. The light control pattern is in accordance with sounds of the media file (e.g., sounds of the music of the mp3 file). During operation, the network module 211 receives the light control pattern and the media file from the cloud server 240 via wireless communication protocol. The control module 212 generates at least a set of light control commands in accordance with the light control pattern and outputs the set of light control commands for controlling the lighting device 230. The pattern-generating module 213 is capable of automatically generating a generated light control pattern in accordance with characteristics of sounds of the media file. The characteristics may include rhythms, beats, accents, and classification of the music of the mp3 file. The pattern-generating module 213 may include an algorithm program which can recognize and analyze the characteristics, and automatically generate corresponding effects in accordance with the time of rhythms, beats, and accents of the music of the mp3 file. If the cloud server 240 has a media file without corresponding light control pattern, the light control device 210 receives the media file, and has the pattern-generating module 213 generate the generated light control pattern. Then the control module 212 generates corresponding light control commands in accordance with the generated light control pattern, and transmits the light control commands to the lighting device 230.

Figure 3:
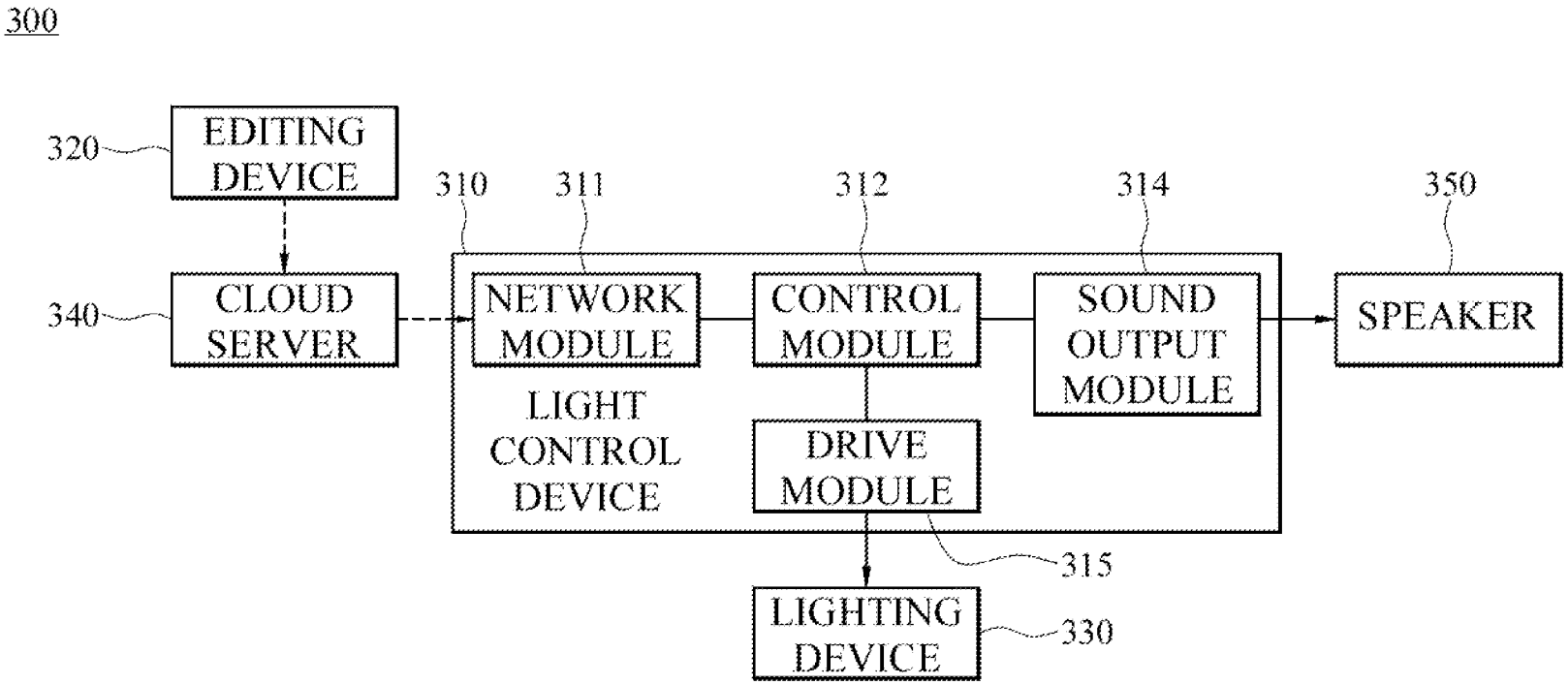
FIG. 3 illustrates a block diagram of a light control system according to a third embodiment of the instant disclosure.

Referring to FIG. 3, FIG. 3 illustrates a block diagram of a light control system 300 according to a third embodiment of the instant disclosure. The light control system 300 of FIG. 3 is similar to the light control system 100 of FIG. 1. In the embodiment, the light control system 300 comprises a light control device 310, an editing device 320, a lighting device 330, a cloud server 340, and a speaker 350. The editing device 320 is signally connected to the cloud server 340 via wireless communication protocol. The cloud server 340 is signally connected to the light control device 310 via wireless communication protocol. The lighting device 330 is connected to the light control device 310 via wires. Users can use the editing device 320 to record, create, and/or edit at least a light control pattern, and to upload light control patterns and/or media files to the cloud server 340. The light control device 310 comprises a network module 311, a control module 312, a sound output module 314, and a drive module 315. The sound output module 314 is connected to the speaker 350 via wires and is capable of outputting signals of sounds of media files. In another embodiment, the sound output module may be signally connected to the speaker 350 via wireless communication protocol. The sound output module 314 may include a digital-to-analog circuit (DAC) and an amplifier capable of driving the speaker 350 to produce sounds. The drive module 315 may include a transformer, a power supplier, and/or a drive circuit to drive the lighting device 330 so that the lighting device 330 has no need of additional power supply. Analogously, the network module 311 can receive the light control pattern and the media file from the cloud server 340 via wireless communication protocol. The control module 312 can generate at least a set of light control commands in accordance with the light control pattern and output the set of light control commands for controlling the lighting device 330. Moreover, the sound output module 314 outputs signals of the music to the speaker 350 corresponding to the light control pattern such that the speaker 350 reproduces sounds of the music with the light control of the lighting device 330. In another embodiment, the speaker can be integrated with the light control device. In another embodiment, the editing device or the cloud server as well as the light control device can comprise the aforementioned pattern-generating module. In the circumstance that the editing device comprises the pattern-generating module, users can have the editing device automatically generate generated light control patterns in accordance with characteristics of sounds of media files and transmit the generated light control patterns to the light control device via, for example, the cloud server. In the circumstance that the cloud sever comprises the pattern-generating module, the cloud sever can automatically generate generated light control patterns in accordance with characteristics of sounds of media files and transmit the generated light control patterns to the light control device in response to requirements of the editing device or the light control device.

For example, a user uploads an mp3 file and an edited light control pattern from the editing device 320 to the cloud server 340. The network module 311 receives the mp3 file and the light control pattern. The control module 312 generates corresponding light control commands, and the drive module 315 drives the lighting device 330 according to the light control commands. In the mean time, the sound output module 314 drives the speaker 350 according to the mp3 file. The length of the music of the media file is 05:03 (5 minutes and 3 seconds); accordingly, the length of the light control pattern corresponding to the music is, but is not limited to, 05:03. The relative positions of 01:00, 02:16, and 04:30 in the light control pattern are respectively recorded with light turning on and off effects, and the relative position of 04:59 in the light control pattern is recorded with a light fading up and out effect. When the light control device 310 starts to control the lighting device 330 and the light control pattern is executed, the speaker 350 starts reproducing sounds of the music of the mp3 file from 00:00, and the lighting device 330 starts from 00:00 with no light turning on. When the time of the playing of the music comes to 01:00, the lighting device 330 is turned on and off. When the time of the playing of the music comes to 02:16 and 04:30, the lighting device 330 is also turned on and off respectively. When the time of the playing of the music comes to 04:59, the lighting device 330 is faded up and out. In other words, the LEDs on the lighting device 330 start to be turned on from 04:59 and then gradually increase its brightness. After the brightness of the LEDs increased to a certain value, the LEDs start to gradually decrease its brightness from 05:01, for example, to 05:03 to be ultimately turned off along with the end of the playing of the music.

It is noted that the cloud server 340 may include vary media files and corresponding light control patterns uploaded from different users who want to share to others. In the case, a user can has his or her light control device 310 download a media file and a corresponding light control pattern edited and uploaded by another user. In this circumstance, the cloud server 340 also plays a role of a sharing platform.

Figure 4:
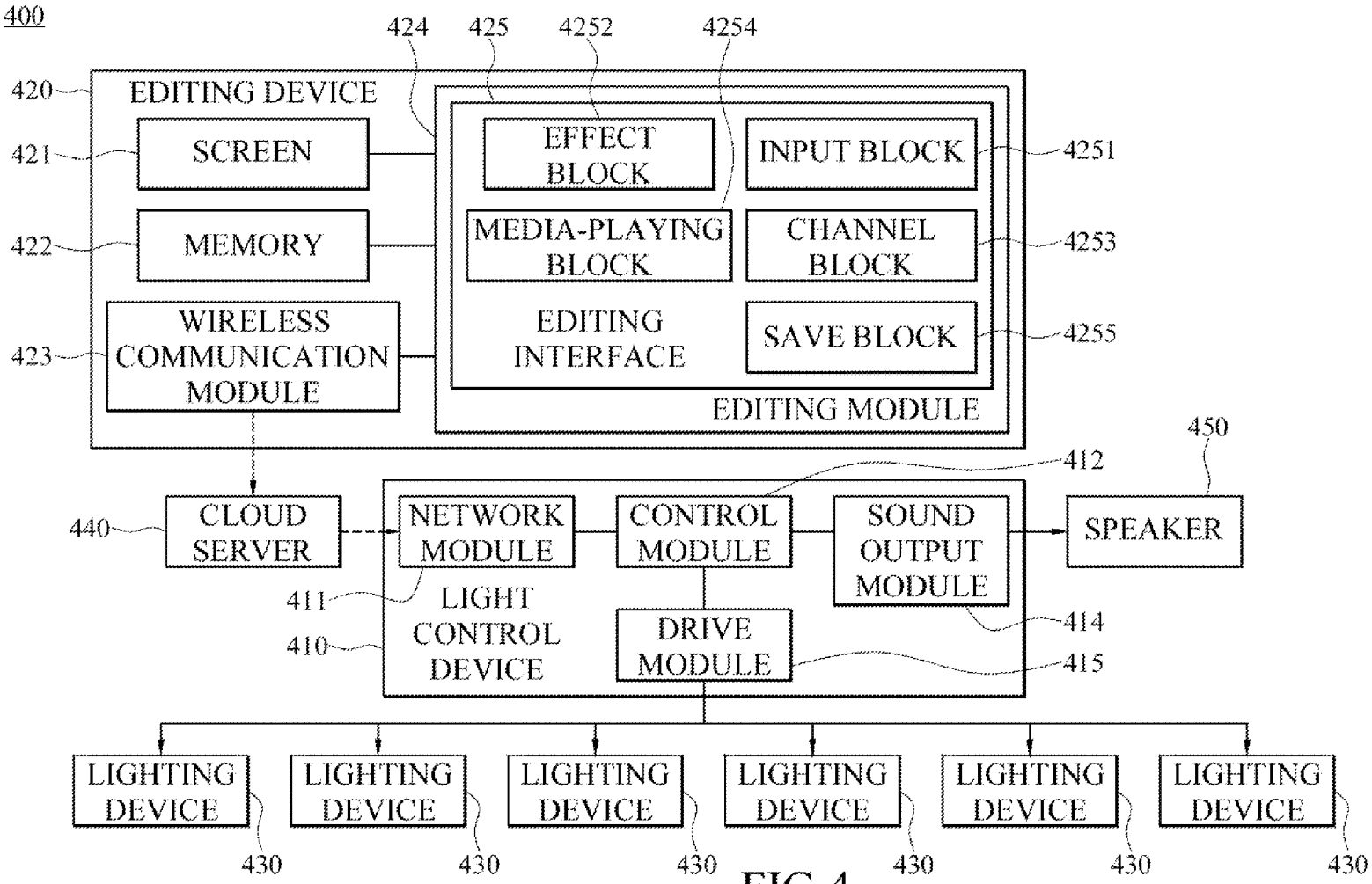
FIG. 4 illustrates a block diagram of a light control system according to a fourth embodiment of the instant disclosure.
Figure 5:
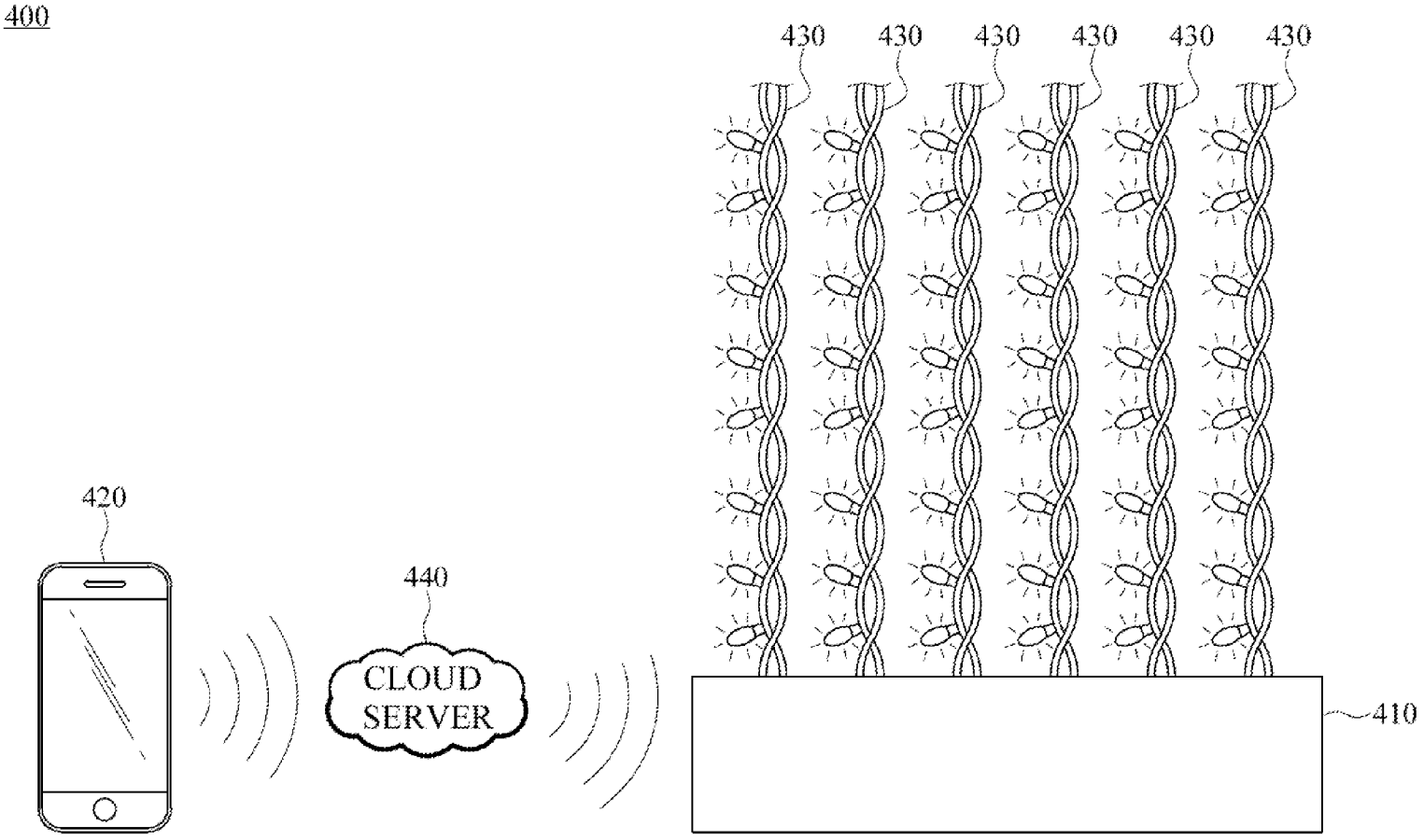
FIG. 5 illustrates a system level diagram according to the fourth embodiment of the instant disclosure.

Referring to FIG. 4 and FIG. 5, FIG. 4 illustrates a block diagram of a light control system 400 according to a fourth embodiment of the instant disclosure, and FIG. 5 illustrates a system level diagram according to the fourth embodiment of the instant disclosure. The light control system 400 of FIG. 4 is similar to the light control system 300 of FIG. 3. In the embodiment, the light control system 400 comprises a light control device 410, an editing device 420, six lighting devices 430, a cloud server 440, and a speaker 450. The editing device 420 is signally connected to the cloud server 440 via wireless communication protocol. The cloud server 440 is signally connected to the light control device 410 via wireless communication protocol. The lighting devices 430 are connected to the light control device 410 via wires. Users can use the editing device 420 to record, create, and/or edit at least a light control pattern, and to upload light control patterns and/or media files to the cloud server 440. The cloud server 440 can transmit the light control patterns and/or media files to the light control device 410. The light control device 410 comprises a network module 411, a control module 412, a sound output module 414, and a drive module 415. The sound output module 414 is connected to the speaker 450 via wires and is capable of outputting signals of sounds of media files. The analogous elements and their relationship and function are described above and have no need to give unnecessary details.

The editing device 420 comprises a screen 421, a memory 422, a wireless communication module 423, and an editing module 424. The screen 421, the memory 422, and the wireless communication module 423 are, but are not limited to, electrically respectively connected to the editing module 424. The editing module 424 comprises an editing interface 425. The screen 421 can be utilized for displaying the editing interface 425, and the screen 421 is, but is not limited to, a touch screen. The wireless communication module 423 can be utilized for being signally connected to the cloud server 440. The memory 422 can be utilized for storing light control patterns and media files. The editing module 424 can be utilized for the edition and record of light control patterns. In the embodiment, the editing device 420 is a smart phone, and the editing module 424 may include hardware such as a micro controller, a second memory, and a touch sensor, and software such as firmware and apps (applications installed in the smart phone).

Figure 6:
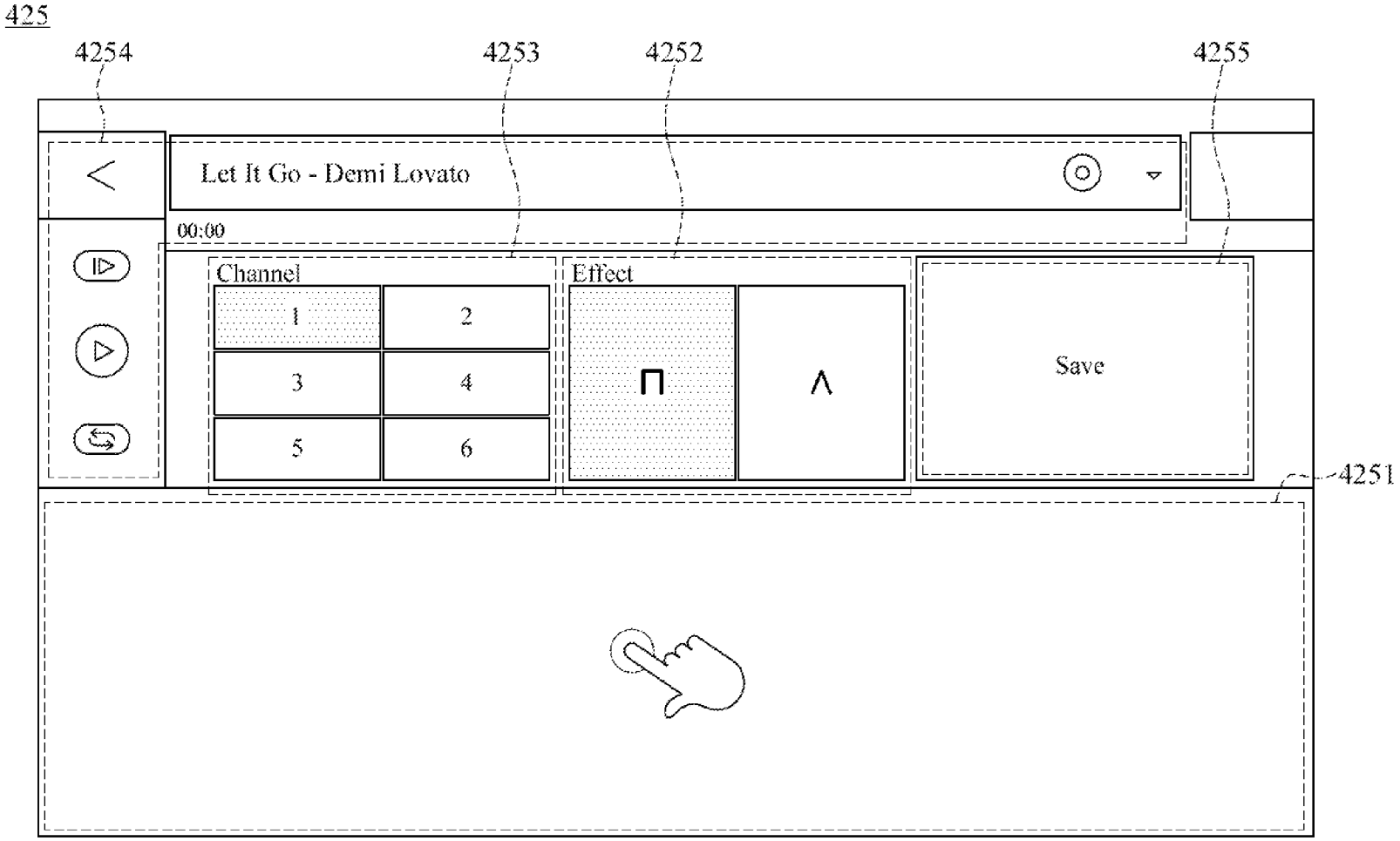
FIG. 6 illustrates an editing interface with a point-touch operation of the light control system according to the fourth embodiment of the instant disclosure.
Figure 7:
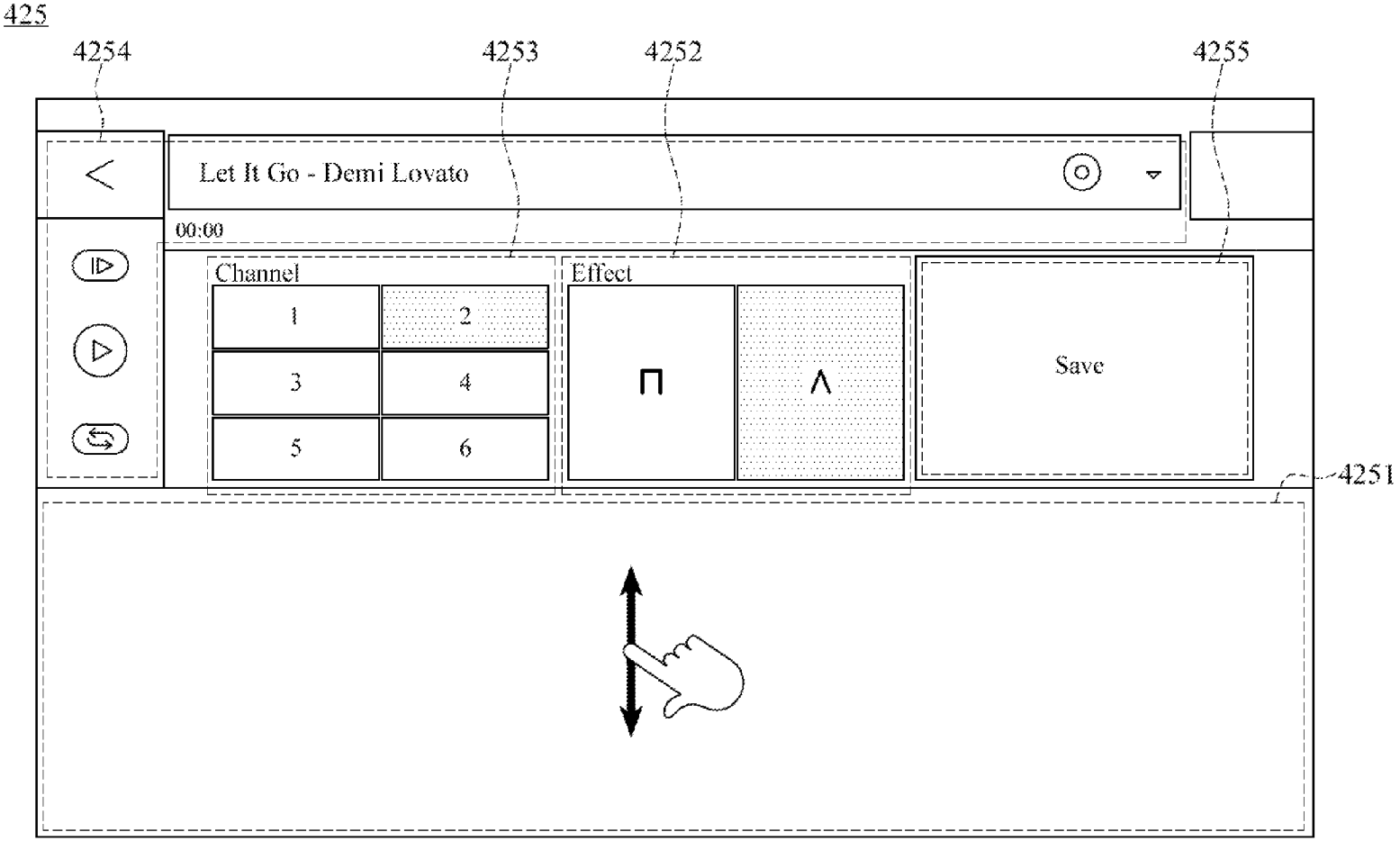
FIG. 7 illustrates the editing interface with a gesture-touch operation of the light control system according to the fourth embodiment of the instant disclosure.

Referring to FIG. 4, FIG. 6, and FIG. 7, FIG. 6 illustrates the editing interface 425 with a point-touch operation of the light control system 400 according to the fourth embodiment of the instant disclosure, and FIG. 7 illustrates the editing interface 425 with a gesture-touch operation of the light control system 400 according to the fourth embodiment of the instant disclosure. The editing interface 425 comprises an input block 4251, an effect block 4252, a channel block 4253, a media-playing block 4254, and a save block 4255. The editing interface 425 is shown, when activated, on the screen 421. In the embodiment, each of the blocks including the input block 4251, the effect block 4252, the channel block 4253, the media-playing block 4254, and the save block 4255 respectively comprises a corresponding program coding and a corresponding interface image. These corresponding interface images are shown on a corresponding area of the screen 421, as shown in FIG. 6 and FIG. 7. Users can touch the area of the screen 421 related to the input block 4251 to activate the input block 4251. When the input block 4251 is activated, the editing module 424 records the time of the activation of the input block in a light control pattern. For example, If a user records and edits a light control pattern from 00:00 to 00:50, and the user touch the input block 4251 of the screen 421 at 00:32 during the recording, the editing module 424 records the time (i.e., 00:32) in the light control pattern and applied an effect (e.g., a corresponding command) to a corresponding position related to the time in the light control pattern. What kind of effect can be applied depends on the selection of the user by touching the effect block 4252. In the embodiment, the effect block 4252 comprises a first effect selection and a second effect selection, as shown in FIG. 6 and FIG. 7. The first selection is marked by a symbol of square wave, and the second selection is marked by a symbol of triangular wave. The first effect selection is related to a light turning on and/or off effect of controlling the lighting device 430, and the second effect selection is related to a light fading up and/or out effect of controlling the lighting device 430. In another embodiment, the editing interface may have no effect block, and the effect related to light control patterns for controlling the lighting device is default (e.g., light turning on and off effect).

As shown in FIG. 6, if the first effect selection is selected, use can touch the input block 4251 in a manner of point-touch (i.e., knocking or pressing on a point of the screen 421 of the input block 4251) to activate the input block 4251. Namely, the input block 4251 is activated when the first effect selection is selected and an area of the touch screen 421 related to the input block 4251 senses a point-touch signal. When pressing on a point of the input block 4251, the effect recorded and related to the time of the activation in the light control pattern is to turn on the lighting device 430. When not pressing on the input block 4251, the effect recorded and related to the time of the activation in the light control pattern is to turn off the lighting device 430. If a light control pattern is edited and recorded under the first selection of the effect block 4252, the controlling of the lighting device 430 according to the light control pattern is similar to a square wave control.

As shown in FIG. 7, if the second effect selection is selected, user can touch the input block 4251 in a manner of gesture-touch (i.e., pressing-and-sliding on the screen 421 of the input block 4251) to activate the input block 4251. Namely, the input block 4251 is activated when the second effect selection is selected and the area of the touch screen 421 related to the input block 4251 senses a gesture-touch signal. When pressing and upwardly sliding on the input block 4251, the effect recorded and related to the time of the activation in the light control pattern is to have the lighting device 430 turned on and faded up (i.e., gradually increasing brightness). When downwardly sliding on the input block 4251, the effect recorded and related to the time of the activation in the light control pattern is to have the lighting device 430 faded out (i.e., gradually decreasing brightness). If a light control pattern is edited and recorded under the second selection of the effect block 4252, the controlling of the lighting device 430 according to the light control pattern is similar to a triangular wave control.

In the embodiment, the channel block 4253 comprises six channels, as shown in FIG. 6 and FIG. 7. Each channel can be related to a corresponding light control pattern. Each light control pattern can be utilized for controlling a corresponding one of the lighting devices 430. Users can touch, for example, the channel 1 of the channel block 4253 to edit and record a corresponding light control pattern related to the channel 1. And users can touch the channel 2 of the channel block 4253 to edit and record another corresponding light control pattern related to the channel 2. Namely, when a channel of the channel block 4253 is activated, the editing module 424 makes a sign on the activated channel (e.g., highlighting the activated channel of the channel block 4253 shown on the screen 421) and relates a light control pattern the user is going to edit to the activated channel.

In the embodiment, the media-playing block 4254 can be, when activated, utilized for playing at least a media file. The editing module 424 can record the time of the activation of the input block 4251 in accordance with the playing of the media file in the light control pattern when the input block is activated. After finishing the edition and record of the light control pattern, users can touch the save block 4255 to have the save block 4255 activated so that the editing module 424 will save the recorded light control pattern and store it in the memory 422. In another embodiment, the light control pattern is automatically continuously saved in the memory during the process of edition. In the embodiment, when once the save block 4255 is activated, the editing device 420 automatically transmits the light control pattern and the media file to the cloud server 440, and the network module 411 of the light control device 410 accordingly receives the light control pattern and the media file from the cloud server 440. In another embodiment, the editing device may not transmit the media file to the cloud server when the save block is activated.

For example, a user wants to edit and record six light control patters in accordance to a song "Let it go" with a length 03:47 and to have the light control device 410 control the six lighting devices 430 in accordance with the song when the speaker 450 is playing "let it go". The user can select the channel 1 (or any other channel) of the channel block 4253. Then the user selects an effect of the effect block 4252. Next the user can start to have the song played by activating the media-playing block 4254 and to edit a light control pattern related to the corresponding channel by activating the input block 4251. During the recording of the light control pattern and the playing of the song, the user touch the screen 421 related to the input block 4251 to edit the light control pattern by point-touch operations or gesture-touch operations according to the selection of the effect block 4252. If the user touch the input block 4251 at 00:32 during the recording and the playing, the editing module 424 records the time (i.e., 00:32) in the light control pattern and applied an effect (e.g., a corresponding command) to a corresponding position related to the time in the light control pattern. After the end of the playing of the song, the light control pattern related to the channel 1 is finish. Then the user can select the channels 2 to 6 one by one until the rest of five light control patterns respectively related to the channels 2 to 6 have edited and recorded. The user touches the save block 4255 and the editing device 420 transmits the edited and recorded light control patterns and the song to the cloud server 440 via the wireless communication module 423. The network module 411 accordingly receives the light control patterns and the song from the cloud server 440 via wireless communication protocol. During operation of the light control device 410, the control module 412 outputs six sets of light control commands for controlling the six lighting device 430 in accordance with the playing of the song "let it go".

It is noted that the light control system 400 may further comprise a plurality of light control devices 410. The light control devices 410 can be connected to and collaborated with each other in order to control more lighting devices 430.

Figure 8:
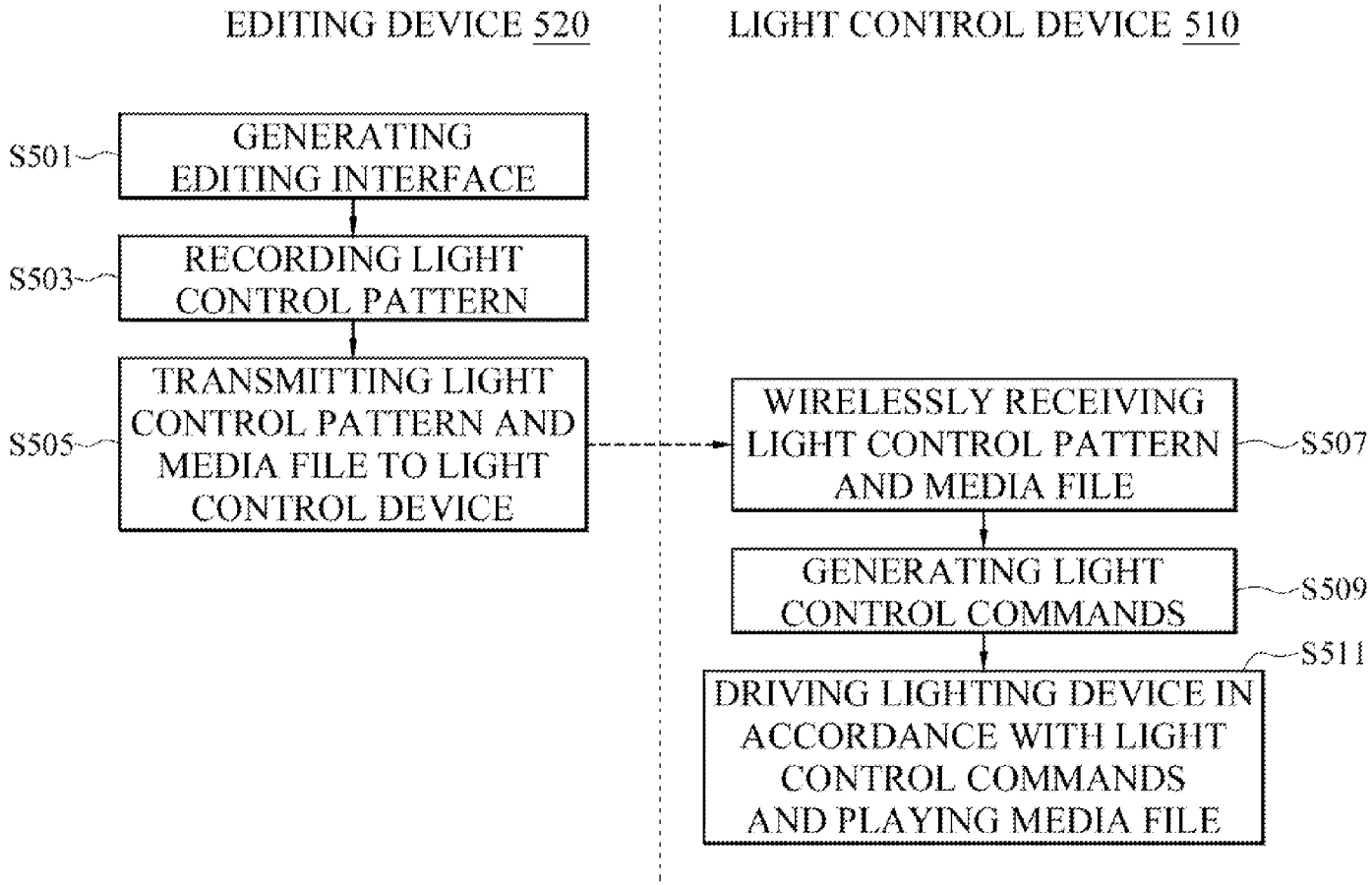
FIG. 8 illustrates a flow chart of a method of light control according to a fifth embodiment of the instant disclosure.

Referring to FIG. 8, FIG. 8 illustrates a flow chart of a method of light control according to a fifth embodiment of the instant disclosure. The flow chart of FIG. 8 can be applied to one or more aforementioned light control systems. The flow chart of FIG. 8 is summarized from the above embodiments. Analogous elements and their relationship and function are described above and have no need to give unnecessary details. In step S501, a user executes an editing interface on an editing device 520. The editing device 520 accordingly generates the editing interface on a touch screen of the editing device 520. In step S503, the user edits and records a light control pattern in accordance with a media file by the editing interface. In step S505, the user finishes the edition of the light control pattern, and has the editing device 520 transmit the light control pattern and the media file to a light control device 510. In step S507, the light control device 510 wirelessly receives the light control pattern and the media file. In step S509, the user activates the light control device 510, and the light control device 510 generates the light control commands in accordance with the light control pattern. In step S511, the light control device 510 drives one or more lighting devices in accordance with the light control commands and plays the media file in the mean time.

Figure 9:
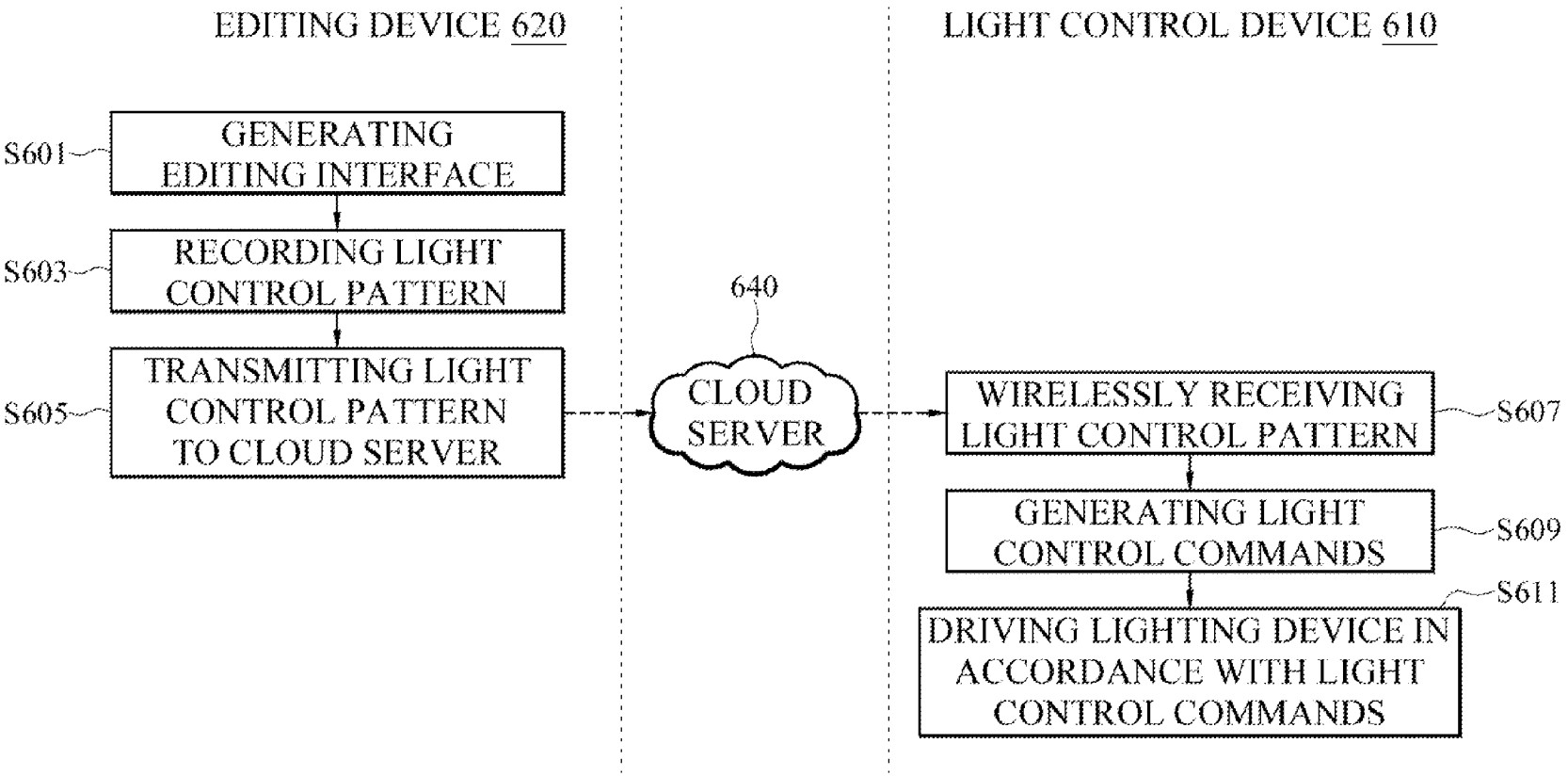
FIG. 9 illustrates a flow chart of a method of light control according to a sixth embodiment of the instant disclosure.

Referring to FIG. 9, FIG. 9 illustrates a flow chart of a method of light control according to a sixth embodiment of the instant disclosure. The flow chart of FIG. 9 can be applied to one or more aforementioned light control systems. The flow chart of FIG. 9 is summarized from the above embodiments. Analogous elements and their relationship and function are described above and have no need to give unnecessary details. In step S601, a user executes an editing interface on an editing device 620. The editing device 620 accordingly generates the editing interface on a touch screen of the editing device 620. In step S603, the user edits and records a light control pattern without media files by the editing interface. For example, the user can sing a song by self and knock an input block of the editing interface on the touch screen along with the rhythms of the song. In step S605, the user finishes the edition of the light control pattern, and has the editing device 620 transmit the light control pattern to a cloud server 640. In step S607, a light control device 610 wirelessly receives the light control pattern. In step S609, the user activates the light control device 610, and the light control device 610 generates the light control commands in accordance with the light control pattern. In step S611, the light control device 610 drives one or more lighting devices in accordance with the light control commands.

Figure 10:
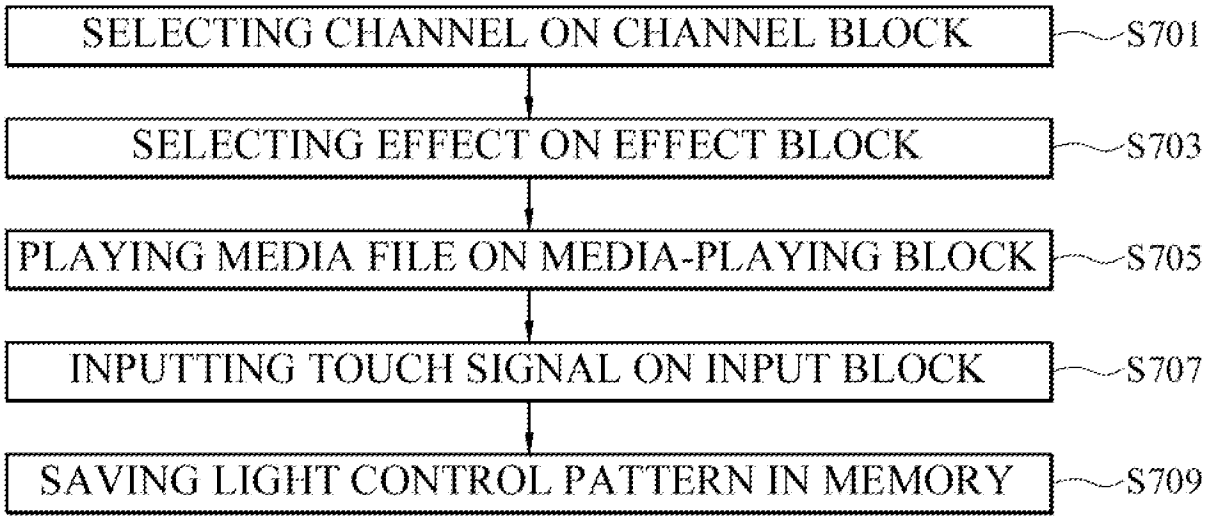
FIG. 10 illustrates a flow chart of a method of the edition of a light control pattern according to a seventh embodiment of the instant disclosure.

Referring to FIG. 10, FIG. 10 illustrates a flow chart of a method of the edition of a light control pattern according to a seventh embodiment of the instant disclosure. The flow chart of FIG. 10 can be applied to one or more aforementioned editing devices. The flow chart of FIG. 10 is summarized from the above embodiments. Analogous elements and their relationship and function are described above and have no need to give unnecessary details. In step S701, a user wanting to edit and record a light control pattern can select a channel of a channel block of an editing interface on an editing device. When a channel is selected (i.e., activated), the channel block has the activated channel marked by a sign (e.g., highlighting the activated channel) and has the light control pattern the user wants to edit related to the activated channel. In step S703, the user can select an effect of an effect block of the editing interface. In step S705, the user can activate a media-playing block of the editing interface to play a media file, and the edition of the light control pattern accordingly starts. In step S707, the user can input touch signals on an input block of the editing interface by touching an area of a touch screen of the editing device so that the edit device records the time of the activation of the input block in the light control pattern in accordance with the playing of the media file. In step S709, the user finishes the edition of the light control pattern. The user can touch a save block of the editing interface to save the light control pattern in the memory and to transmit the light control pattern to a light control device.

It shall be understood that a sequence for executing the described steps can be various according to different situation. And ordinal numbers such as "first", "second", and "third" used before elements or values are not intended to imply priorities or sequences. These ordinal numbers are merely utilized for clarifying different elements or values with the same name.

While the instant disclosure has been described by way of example and in terms of the preferred embodiments, it is to be understood that the instant disclosure needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. A light control device, comprising:

a network module receiving at least a light control pattern from an editing device or a cloud server via wireless communication protocol and receiving at least a media file, wherein the light control pattern is edited and is in accordance with sounds of the media file; and a control module, wherein the control module generates at least a set of light control commands in accordance with the light control pattern and outputs the set of light control commands for controlling at least a lighting device with the playing of the media file.

2. The light control device of claim 1, further comprising a sound output module, wherein the sound output module is capable of being signally connected to a speaker and outputting signals of sounds of the media file.

3. The light control device of claim 1, further comprising a pattern-generating module, wherein the pattern-generating module is capable of automatically generating a generated light control pattern in accordance with characteristics of sounds of the media file.

4. The light control device of claim 1, wherein the editing device is a smart phone, a tablet computer, or a laptop computer.

5. A light control system, comprising:

an editing device comprising:

an editing module comprising an editing interface, wherein the editing interface comprises an input block;

a screen displaying the editing interface, wherein when the input block is activated, the editing module records the time of the activation of the input block in a light control pattern; and a wireless communication module receiving the light control pattern for transmission; and at least a light control device comprising:

a network module receiving the light control pattern via wireless communication protocol; and a control module, wherein the control module generates at least a set of light control commands in accordance with the light control pattern and outputs the set of light control commands for controlling at least a lighting device.

6. The light control system of claim 5, wherein the editing interface further comprises a channel block, and when a channel of the channel block is activated, the editing module makes a sign on the activated channel and relates the light control pattern to the activated channel.

7. The light control system of claim 5, wherein the editing device further comprises a memory, the editing interface further comprises a save block, and when the save block is activated, the editing module saves the recorded light control pattern in the memory.

8. The light control system of claim 7, further comprising a cloud server, wherein when the save block is activated, the editing device transmits the light control pattern to the cloud server, and the network module of the light control device receives the light control pattern from the cloud server.

9. The light control system of claim 8, wherein the editing interface further comprises a media-playing block playing at least a media file, the editing module records the time of the activation of the input block in accordance with the playing of the media file in the light control pattern when the input block is activated, the wireless communication module further receives the media file for transmission, the network module accordingly receives the media file, and the control module outputs the set of light control commands for controlling the lighting device when the media file is played.

10. The light control system of claim 9, wherein the editing device, the light control device, or the cloud server further comprises a pattern-generating module, and the pattern-generating module is capable of automatically generating a generated light control pattern in accordance with characteristics of sounds of the media file.

11. The light control system of claim 5, wherein the editing interface further comprises an effect block, and when an effect of the effect block is activate, the editing module has the activated effect correspond to the time of the activation of the input block in the light control pattern.

12. The light control system of claim 11, wherein the effect block comprises a first effect selection and a second effect selection, the first effect selection is related to a light turning on or off effect of controlling the lighting device, and the second effect selection is related to a light fading up or out effect of controlling the lighting device.

13. The light control system of claim 12, wherein the screen is a touch screen, and the input block is activated when an area of the touch screen related to the input block senses a point-touch signal or a gesture-touch signal.

14. The light control system of claim 5, wherein the editing device is a smart phone, a tablet computer, or a laptop computer.

15. A method of light control, comprising:

wirelessly receiving a light control pattern from an editing device or a cloud server and a media file by a light control device, wherein the light control pattern is edited and is in accordance with sounds of the media file;

generating a set of light control commands in accordance with the light control pattern on the light control device; and driving at least a lighting device in accordance with the set of light control commands by the light control device with the playing of the media file.

16. The method of light control of claim 15, further comprising generating an editing interface on the editing device, wherein the editing interface comprises:

an input block having, when activated, the time of activation of the input block recorded in the light control pattern; and a save block saving, when activated, the light control pattern.

17. The method of light control of claim 16, wherein the editing interface further comprises:

a media-playing block playing, when activated, the media file, wherein the record of the time of activation of the input block is in accordance with the playing of the media file;

a channel block having, when activated, an activated channel marked by a sign and the light control pattern related to the activated channel; and an effect block having, when activated, an activated effect correspond to the time of the activation of the input block in the light control pattern.

18. The method of light control of claim 17, wherein the effect block comprises a first effect selection and a second effect selection, the first effect selection is related to a light turning on or off effect of controlling the lighting device, and the second effect selection is related to a light fading up or out effect of controlling the lighting device.

19. The method of light control of claim 18, wherein the input block is activated when the first effect selection is selected and an area of a touch screen related to the input block senses a point-touch signal, or the input block is activated when the second effect selection is selected and the area of the touch screen related to the input block senses a gesture-touch signal.

* * * * *